US012747885B2

(12) United States Patent
Kim et al.

(10) Patent No.: US 12,747,885 B2
(45) Date of Patent: Sep. 29, 2026

(54) AIR PURIFIER

(71) Applicant: COWAY CO., LTD., Gongju-si (KR)

(72) Inventors: Ki Soo Kim, Seoul (KR); Myoung Jun Lee, Seoul (KR); Yu Young Nam, Seoul (KR); Jae Hong Kim, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 355 days.

(21) Appl. No.: 18/556,126

(22) PCT Filed: Apr. 12, 2022

(86) PCT No.: PCT/KR2022/005235
§ 371 (c)(1),
(2) Date: Oct. 19, 2023

(87) PCT Pub. No.: WO2022/225243
PCT Pub. Date: Oct. 27, 2022

(65) Prior Publication Data

US 2024/0219061 A1 Jul. 4, 2024

(30) Foreign Application Priority Data

Apr. 21, 2021 (KR) ..... 10-2021-0052019
Oct. 27, 2021 (KR) ..... 10-2021-0144913

(51) Int. Cl.
*F24F 11/79* (2018.01)
*F24F 8/108* (2021.01)
(Continued)

(52) U.S. Cl.
CPC ..... *F24F 11/79* (2018.01); *F24F 8/108* (2021.01); *F24F 8/80* (2021.01); *F24F 13/14* (2013.01)

(58) Field of Classification Search
CPC .... F24F 11/79; F24F 8/80; F24F 8/108; F24F 13/14
(Continued)

(56) References Cited

U.S. PATENT DOCUMENTS 9,914,082 B2 * 3/2018 Park ..... B01D 46/4227
10,495,104 B2 * 12/2019 Park ..... B01D 46/2403
(Continued)

FOREIGN PATENT DOCUMENTS

CN 106871249 A 6/2017
CN 209325969 U 8/2019
(Continued)

OTHER PUBLICATIONS

International Search Report issued Jul. 19, 2022 in PCT/KR2022/005235, filed on Apr. 12, 2022, 5 pages (with English Translation).
(Continued)

*Primary Examiner* — Avinash A Savani
*Assistant Examiner* — Dana K Tighe
(74) *Attorney, Agent, or Firm* — Oblon, McClelland, Maier & Neustadt, L.L.P.

(57) ABSTRACT

An air purifier includes: a body having an inlet introducing air; a blower accommodated in the body and providing blowing force for flow of air; a filter filtering the air introduced into the body; a wind direction control unit adjusting a filtered air discharging direction; a manipulation module for outputting a signal manipulated by user; and a control device controlling the wind direction control unit based on the signal. The wind direction control unit includes: a wind direction control member rotating about the body about an axis extending horizontally; a motor providing driving force for rotating the wind direction control member; a driving gear rotated by the driving force of the motor; and a driven gear rotated by the driving gear. The
(Continued)

control device controls the motor so that when the driving gear is rotated and then stopped, the driving gear is stopped after reversely rotated by a predetermined angle.

8 Claims, 8 Drawing Sheets

(51) Int. Cl.
*F24F 8/80* (2021.01)
*F24F 13/14* (2006.01)

(58) Field of Classification Search
USPC ..... 454/229
See application file for complete search history.

(56) References Cited

U.S. PATENT DOCUMENTS

| | | | | |
|---|---|---|---|---|
| 10,914,488 | B2 * | 2/2021 | Chun | F24F 13/10 |
| 11,364,459 | B2 * | 6/2022 | Jung | F24F 13/28 |

FOREIGN PATENT DOCUMENTS

| | | | |
|---|---|---|---|
| JP | 11-83152 | A | 3/1999 |
| JP | 2006-180648 | A | 7/2006 |
| JP | 2017-172852 | A | 9/2017 |
| JP | 2019-512077 | A | 5/2019 |
| KR | 10-2014-0096971 | A | 8/2014 |
| KR | 10-1932513 | B1 | 12/2018 |
| KR | 10-2019-0106453 | A | 9/2019 |
| WO | WO 2017/101856 | A1 | 6/2017 |

OTHER PUBLICATIONS

Office Action issued Aug. 6, 2024, in corresponding Japanese Patent Application No. 2023-564243 (with English Translation), 11 pages.
Office Action dated Mar. 19, 2026, issued in Chinese application No. 202280030043.7, citing documents 1 and 2 therein.

* cited by examiner

AIR PURIFIER

TECHNICAL FIELD

The present disclosure relates to an air purifier.

BACKGROUND ART

In general, an air purifier is a device for sucking polluted indoor air, and filtering out dust, odor particles, and the like contained in the air through a filter to purify the air into clean air. The air purifier can purify indoor air by sucking in and purifying the surrounding polluted air, and then discharging the purified clean air to the outside of the air purifier.

Such an air purifier includes a blowing fan for introducing air into the air purifier, a filter for filtering out dust and odor particles contained in the air, a wind direction control unit that rotates to discharge clean filtered air that has passed through the filter in various directions, and a manipulation module manipulated by a user. The user can manipulate the manipulation module to rotate the blowing fan and the wind direction control unit.

In this regard, Korean Patent Application Publication No. 10-2019-0049675 "Air purifier" (hereinafter, Patent Document 1) of LG Electronics Co., Ltd. discloses an air purifier including a fan housing for discharging air, a second rack for rotating the fan housing in an up-down direction, a flow diverter including a second gear engaged with the second rack to be rotated, and a display device disposed on the fan housing and manipulated by a user.

However, Patent Document 1 only discloses that the second gear is engaged with the second rack to be rotated to rotate the fan housing in the up-down direction, but does not disclose that the second gear is re-rotated to prevent the second rack from being rotated about the second gear by an external force after the second gear is stopped. In other words, according to Patent Document 1, when the user presses the display device after the rotation of the second gear is stopped, the display may shake against the fan housing due to the gap between the second rack and the second gear, and the shaking due to the gap may be unpleasant to the user.

DETAILED DESCRIPTION OF INVENTION

Technical Problems

In view of the above, one embodiment of the present disclosure provides an air purifier in which when a user manipulates a manipulation module after a driving gear is rotated and then stopped, shaking of the manipulation unit caused by the user's operation is minimized.

Technical Solution

In accordance with an aspect of the present disclosure, there is provided an air purifier including: a body having an inlet through which air is introduced; a blower accommodated in the body and providing a blowing force for causing the air to flow; a filter filtering the air introduced into the body; a wind direction control unit that adjusts a direction in which the filtered air passing through the filter is discharged; a manipulation module that is manipulated by a user and outputs a signal; and a control device for controlling the wind direction control unit in response to the signal, wherein the wind direction control unit includes: a wind direction control member configured to be rotatable with respect to the body about a rotation axis extending in a horizontal direction; a motor that provides a driving force for rotating the wind direction control member; a driving gear rotated by the driving force provided by the motor; and a driven gear rotated by the driving gear, wherein the manipulation module is disposed on the wind direction control member to be spaced apart from the rotation axis when viewed from above, wherein when the driving gear rotates in a forward direction, the wind direction control member rotates in a direction in which the manipulation module moves downward, and when the driving gear rotates in a reverse direction opposite to the forward direction, the wind direction control member rotates in a direction in which the manipulation module moves upward, and wherein the control device controls the motor so that when the driving gear is rotated and then stopped, the driving gear is stopped after rotated in the reverse direction by a predetermined angle.

The driving gear may include a plurality of driving gear teeth, the driven gear may include a plurality of driven gear teeth, the plurality of driven gear teeth may include a first driven gear tooth and a second driven gear tooth disposed adjacent to the first driven gear tooth, the plurality of driving gear teeth may include an engagement driving gear tooth disposed between the first driven gear tooth and the second driven gear tooth, the driven gear rotates as the engagement driving gear tooth comes in close contact with the first driven gear tooth when the driving gear rotates in the forward direction, and the driven gear rotates as the engagement driving gear tooth comes in close contact with the second driven gear tooth when the driving gear rotates in the reverse direction, and the control device may control the motor so that when the driving gear is rotated in the forward direction and then stopped, the driving gear may be rotated in the reverse direction and the engagement driving gear tooth come into close contact with the second driven gear tooth.

When the driving gear is rotated in the forward direction and then stopped, the control device may control the motor so that the driving gear is rotated in the reverse direction by a predetermined first angle and the engagement driving gear tooth come into close contact with the second driven gear tooth.

When the driving gear is rotated in the reverse direction and then stopped, the control device may control the motor so that the driving gear is rotated in the reverse direction by a second angle different from the first angle and the engagement driving gear tooth come into close contact with the second driven gear tooth.

The first angle may be greater than the second angle.

The air purifier may further include an elevating unit configured to move the wind direction control unit upward and downward, wherein the wind direction control unit is spaced apart upward from the body by the elevating unit to be placed in an open state in which an upper portion of the body is opened, or comes in close contact with the body by the elevating unit to be placed in a closed state in which the upper portion of the body is closed, and wherein when the wind direction control unit is switched to the closed state, the driving gear is rotated in the reverse direction so that the engagement driving gear tooth come into close contact with the second driven gear tooth.

When the wind direction control unit is switched to the closed state, the wind direction control unit may be driven so that the wind direction control member descends toward the body by a first distance from the open state, then ascends by a second distance smaller than the first distance, and then descends toward the body again, and the driving gear may be rotated in the reverse direction so that the engagement driving gear tooth come into close contact with the second driven gear tooth after the wind direction control member ascends by the second distance.

When the wind direction control unit is switched to the closed state, the driving gear may be rotated in the reverse direction so that the engagement driving gear tooth come in close contact with the second driven gear tooth before the wind direction control member starts to descend.

Effect of Invention

According to one aspect of the present disclosure, it is possible to minimize shaking of the manipulation module by the user's force pressing the manipulation module.

BEST MODE FOR CARRYING OUT THE INVENTION

Hereinafter, a preferred embodiment of the present disclosure for implementing the spirit of the present disclosure will be described in more detail with reference to the accompanying drawings.

However, in describing the present disclosure, detailed descriptions of known configurations or functions may be omitted to clarify the present disclosure.

When an element is referred to as being 'supported' by, 'flowed' in, 'discharged' out, or 'flow' another element, it should be understood that the element may be directly connected to, supported by, flowed in, discharged out or flow other element, but that other elements may exist in the middle.

The terms used in the present disclosure are only used for describing specific embodiments, and are not intended to limit the present disclosure. Singular expressions include plural expressions unless the context clearly indicates otherwise.

Terms including ordinal numbers, such as first and second, may be used for describing various elements, but the corresponding elements are not limited by these terms. These terms are only used for the purpose of distinguishing one element from another element.

In the present specification, it is to be understood that the terms such as "including" are intended to indicate the existence of the certain features, areas, integers, steps, actions, elements and/or combinations thereof disclosed in the specification, and are not intended to preclude the possibility that one or more other certain features, areas, integers, steps, actions, elements and/or combinations thereof may exist or may be added.

Further, it should be noted in advance that expressions for directions such as up and down in the specification are explained based on the drawings, and may be expressed differently if the direction of a corresponding object changes. Meanwhile, in the specification, an up and down direction may be the z-axis direction of FIGS. 1 and 3.

Hereinafter, a specific configuration of an air purifier 1 according to one embodiment of the present disclosure will be described with reference to the drawings.

Figure 1:
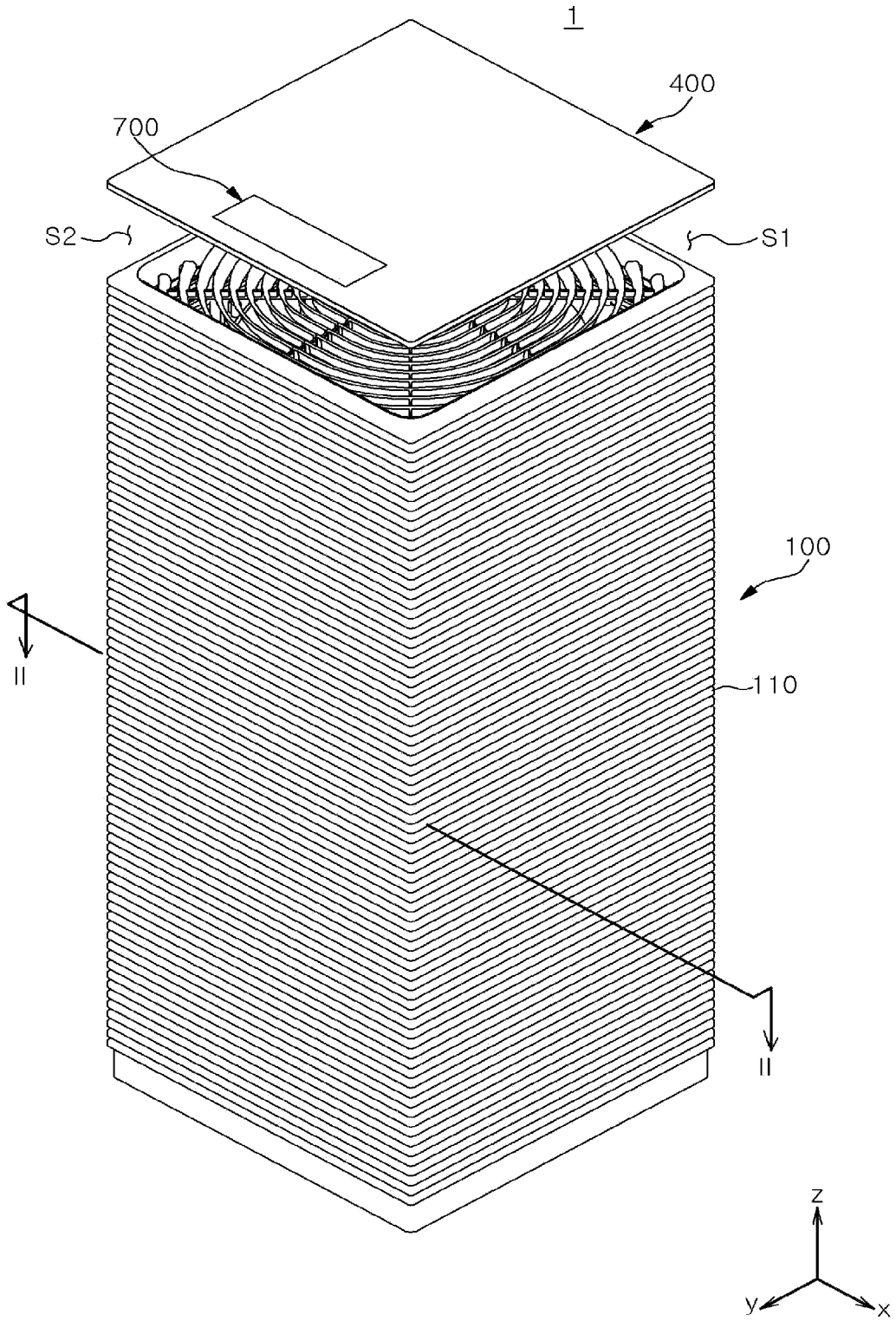
FIG. 1 is a perspective view showing an air purifier according to a first embodiment of the present disclosure.
Figure 2:
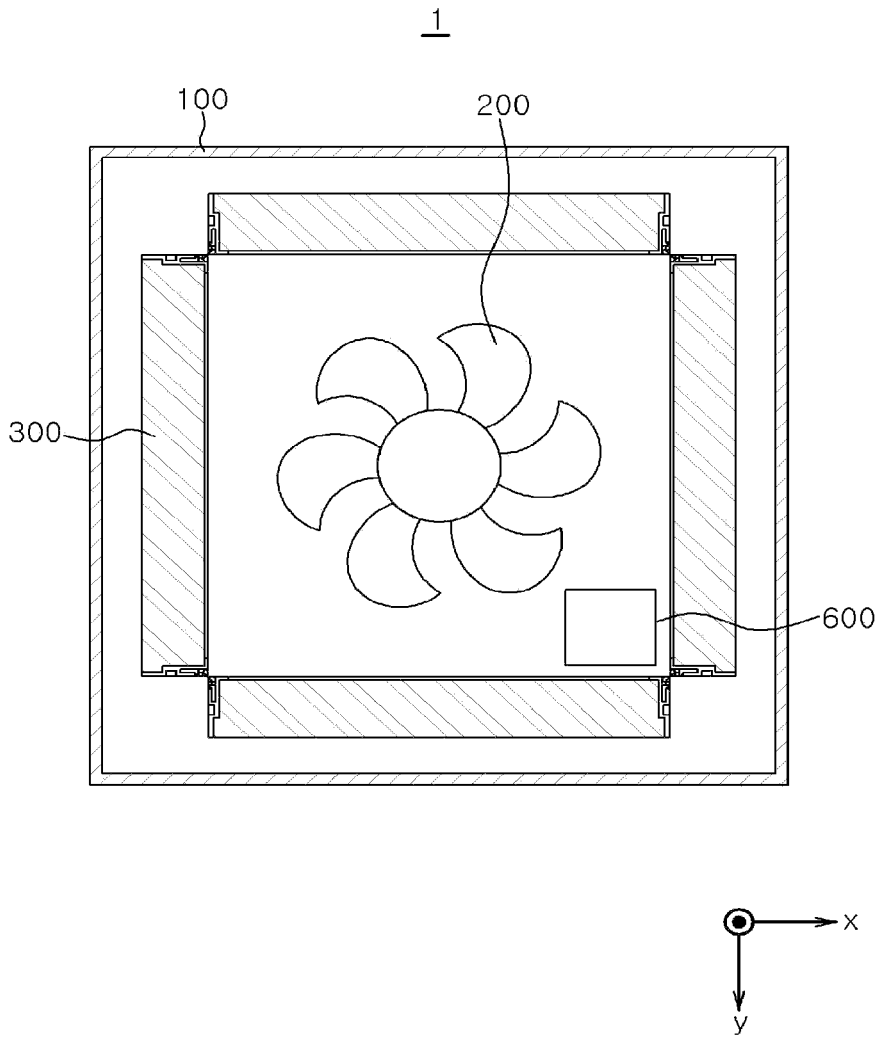
FIG. 2 is a cross-sectional view taken along line II-II of FIG. 1.
Figure 3:
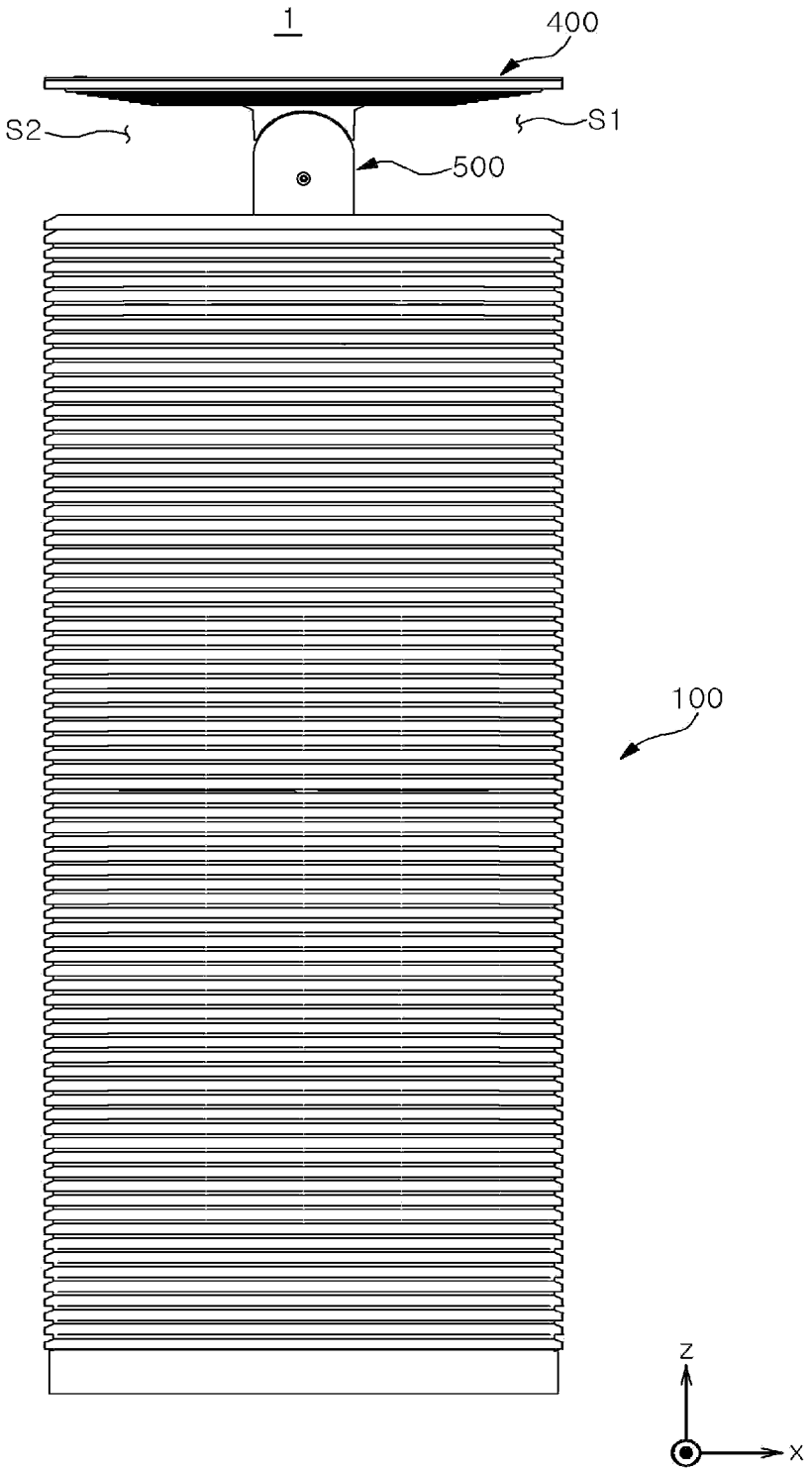
FIG. 3 is a side view of the air purifier of FIG. 1.

Referring to FIGS. 1 to 3, the air purifier 1 according to one embodiment of the present disclosure can purify polluted air into clean air by filtering out dust, odor particles, and the like in the air introduced into the air purifier 1. The air purifier 1 can suck outside air into the air purifier 1 and discharge clean air purified therein to the outside. The air purifier 1 may include a body 100, a blower 200, a filter 300, a wind direction control unit 400, an elevating unit 500, a control device 600, and a manipulation module 700.

The body 100 may accommodate the blower 200 and the filter 300 therein, and may support the blower 200, the filter 300, the wind direction control unit 400, and the elevating unit 500. The body 100 may have an inlet 110 through which air outside the air purifier 1 flows into the air purifier 1. The inlet 110 may be formed to penetrate through the body 100 and may include a plurality of inlets. The plurality of inlets 110 may be formed along a perimeter of the body 100. In addition, the body 100 may be configured to form all or some of an outlet for discharging the filtered air to the outside of the air purifier 1. Moreover, an upper portion of the body 100 may be opened and closed by the wind direction control unit 400.

The blower 200 may provide a blowing force for introducing air outside the air purifier 1 into the air purifier 1 and then discharging the air to the outside. In addition, the blower 200 may be driven to discharge the air filtered by the filter 300 to the outside of the air purifier 1. The blower 200 may be arranged to be surrounded by a plurality of filters 300.

The filter 300 may filter external air into clean air. For example, the filter 300 may include well-known filters such as a pre-filter, a HEPA filter, and a deodorization filter to filter dust and odor particles in the air. In addition, the filter 300 may include a filter member and a filter frame for supporting the filter member. The filter 300 may include a plurality of filters, and the plurality of filters may be configured to be folded or unfolded with respect to adjacent filters.

Figure 4:
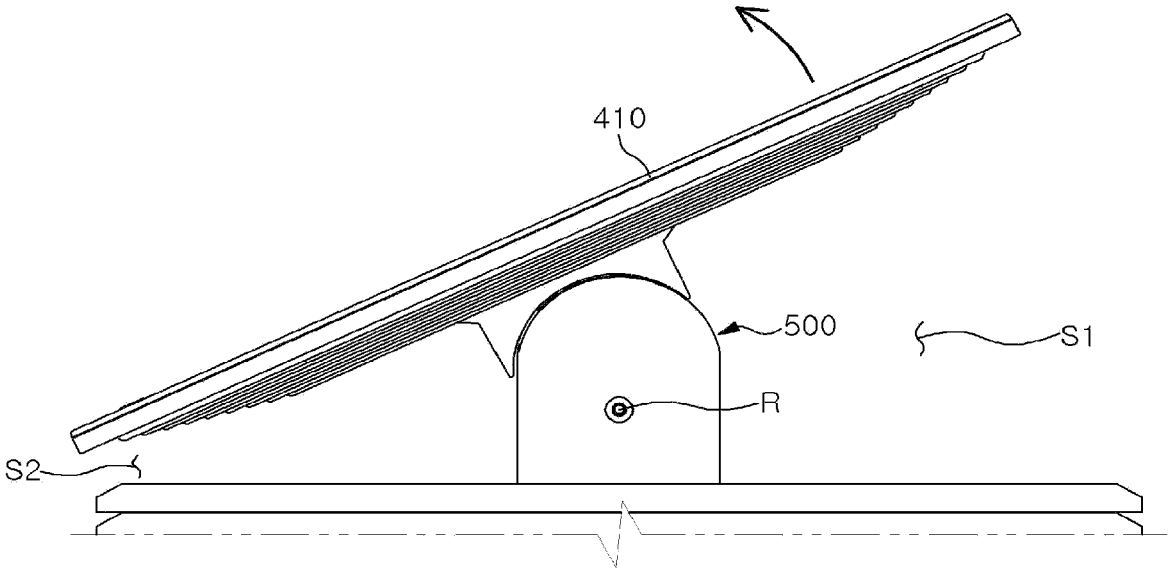
FIG. 4 is a side view of the air purifier of FIG. 1.
Figure 5:
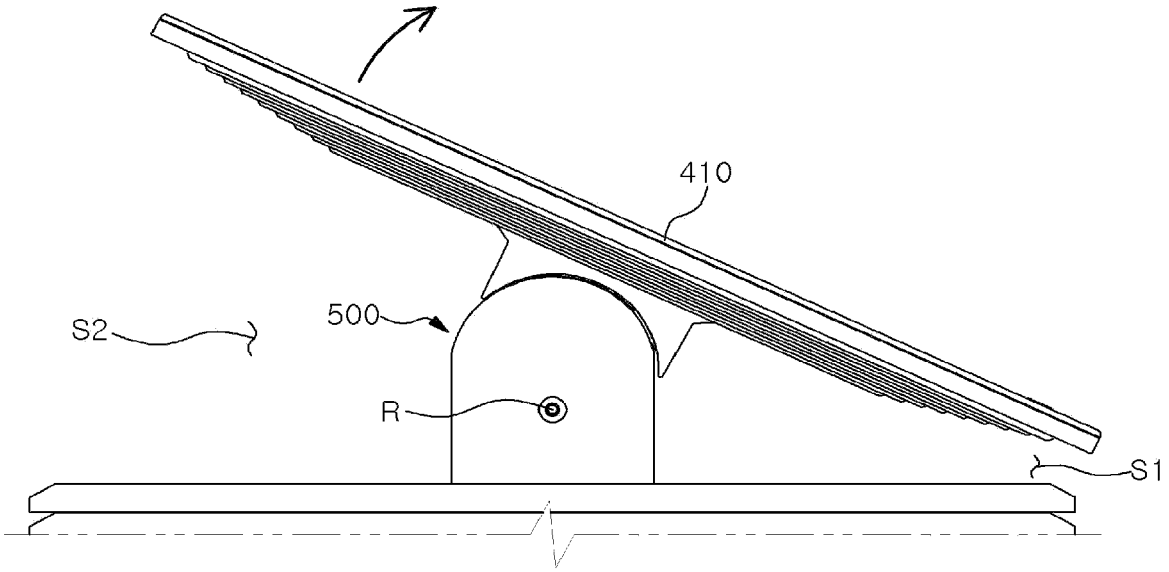
FIG. 5 is a side view of a wind direction control unit when a driving gear of the air purifier of FIG. 1 is rotated in a forward direction.
Figure 6:
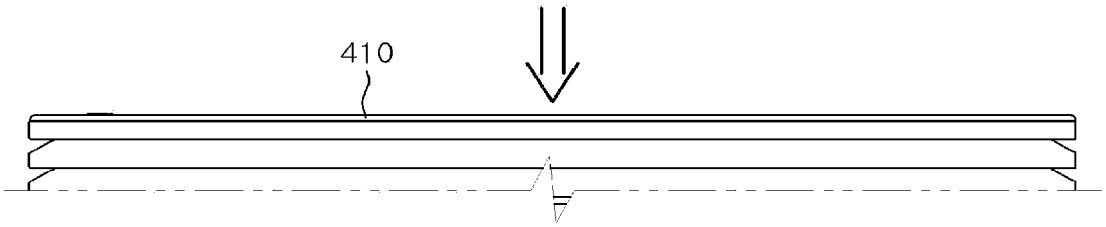
FIG. 6 is a side view of the wind direction control unit of the air purifier of FIG. 1 in a closed state.

Referring to FIGS. 4 to 6, the wind direction control unit 400 may adjust a direction in which filtered air passing through the filter 300 is discharged. The wind direction control unit 400 may be configured to be rotatable with respect to the body 100 about a rotating shaft R extending in a horizontal direction. The wind direction control unit 400 may include a wind direction control member 410, a motor 420, a driving gear 430, and a driven gear 440.

The wind direction control member 410 is configured to be rotatable with respect to the body 100 about the rotating shaft R extending in the horizontal direction. For example, the wind direction control member 410 may be rotated to be tilted at a predetermined angle with respect to the body 100 or to be placed in a horizontal state in which it is parallel to the body. In addition, when viewed from above, the wind direction control member 410 may be disposed such that the manipulation module 700 is spaced apart from the rotating shaft R of the wind direction control member 410.

The motor may provide a driving force for rotating the wind direction control member 410. The motor 420 may be driven to rotate the wind direction control member 410 in one direction or in another direction opposite to the one direction. In other words, the wind direction control member 410 may be rotated by the motor 420 to tilt to one side or to tilt to the other side.

Figure 7:
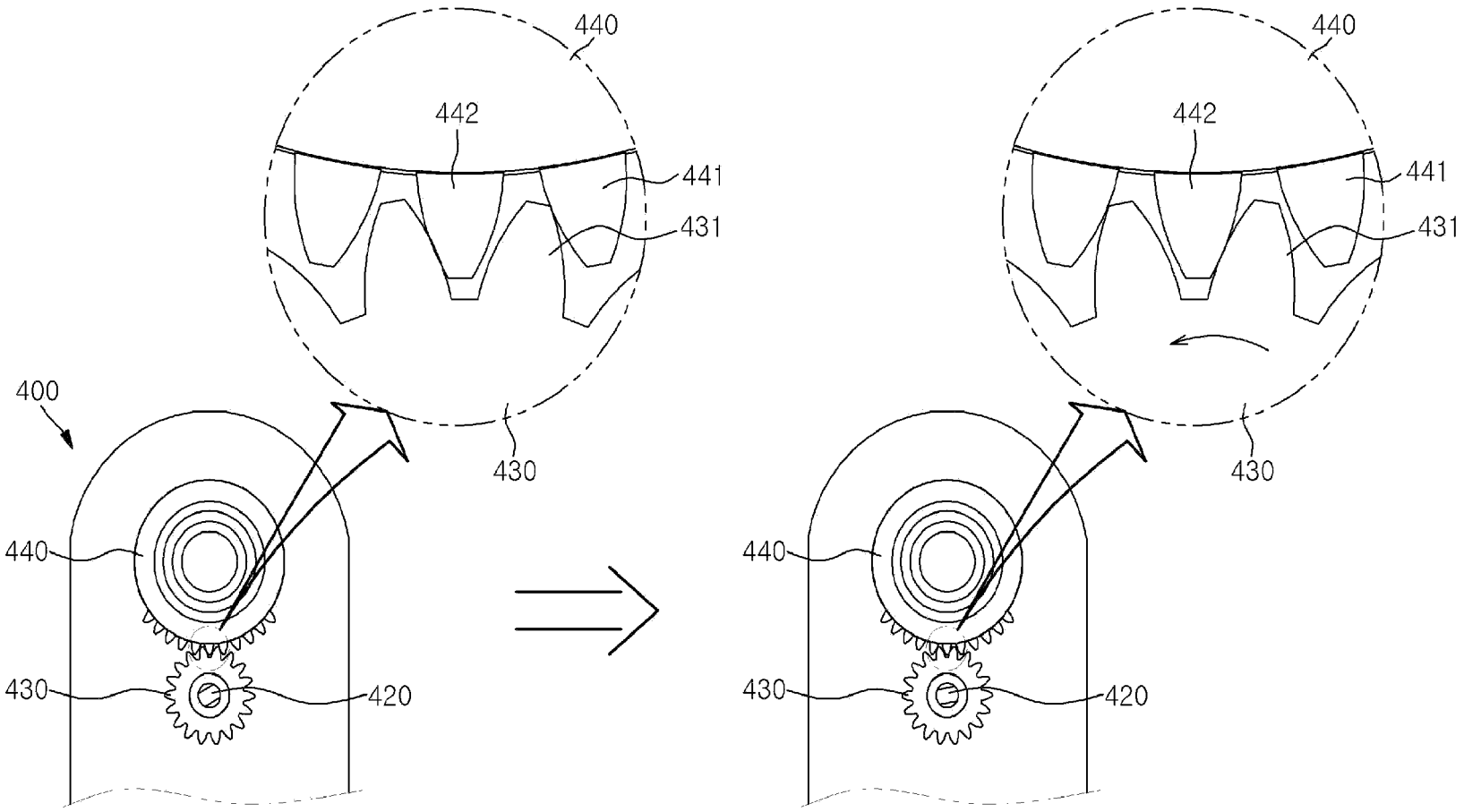
FIG. 7 is a plan view of the driving gear and a driven gear when the driving gear of the air purifier of FIG. 1 is rotated in the forward direction and then rotated in a reverse direction.
Figure 8:
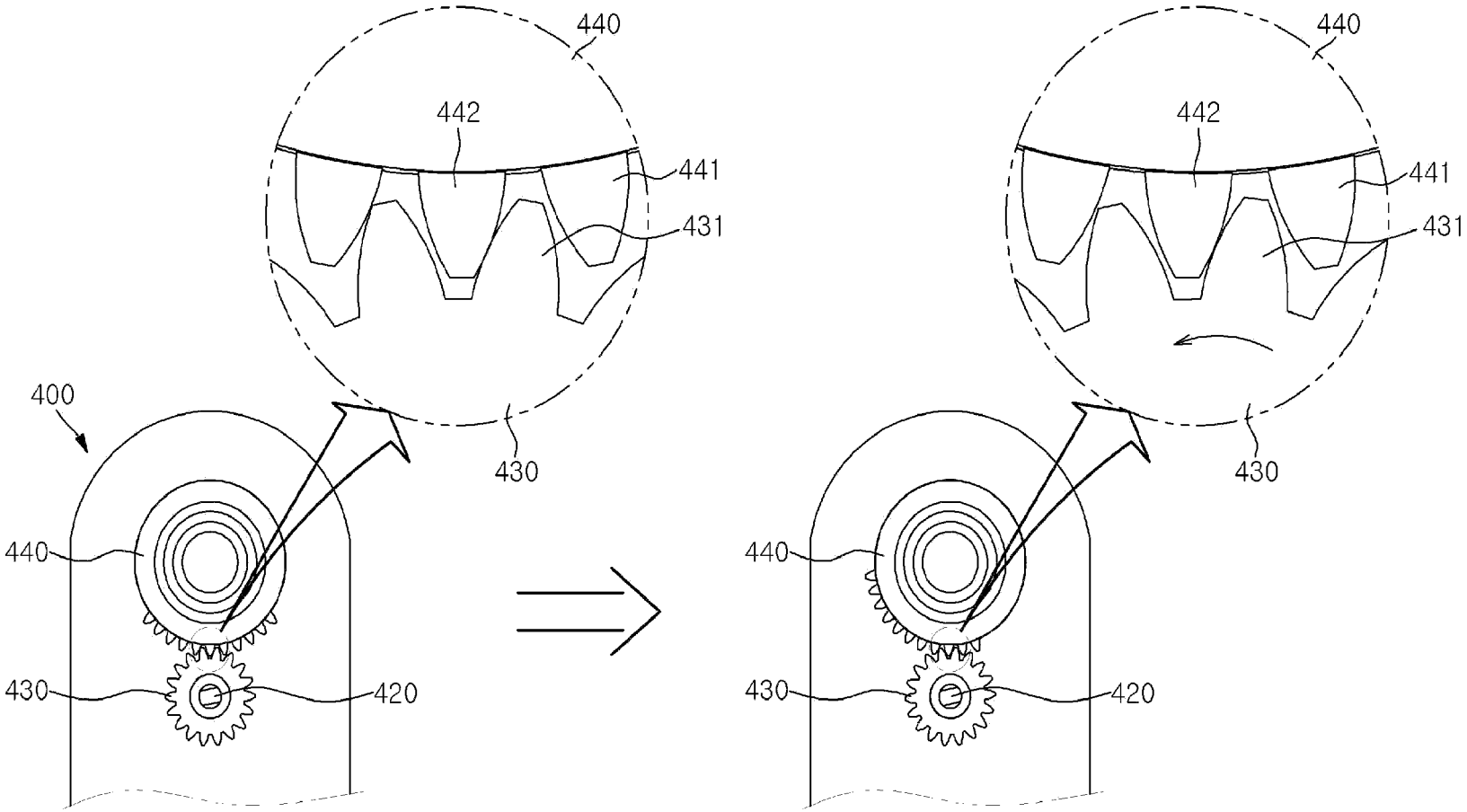
FIG. 8 is a plan view of the driving gear and the driven gear when the driving gear of the air purifier of FIG. 1 is rotated in the reverse direction after it has been rotated in the reverse direction.

Referring further to FIGS. 7 and 8, the driving gear 430 may be rotated by the driving force provided by the motor 420. When the driving gear 430 is rotated in a forward direction, the wind direction control member 410 may be rotated in a direction in which the manipulation module 700 moves down. In addition, when the driving gear 430 is rotated in a reverse direction opposite to the forward direction, the wind direction control member 410 may be rotated in a direction in which the manipulation module 700 moves up.

In addition, the driving gear 430 may include a plurality of driving gear teeth 431. The driving gear 430 may be engaged with the driven gear 440 so that arbitrary driving gear teeth 431 among the plurality of driving gear teeth 431 are sequentially disposed between a plurality of driven gear teeth 441 and 442 to be described later according to the rotation direction.

The driven gear 440 may be engaged with the driving gear 430 and rotated by the driving gear 430. For example, the driven gear 440 may be disposed above the driving gear 430 and engaged with the driving gear 430. The wind direction control member 410 may be rotated by the rotation of the driven gear 440. In addition, the driven gear 440 may include a plurality of driven gear teeth. The plurality of driven gear teeth may be arranged at regular intervals over the entire circumference of the driven gear 440 or may be arranged at regular intervals only on a portion of the circumference of the driven gear 440. The plurality of driven gear teeth may include a first driven gear tooth 441 and a second driven gear tooth 442 disposed adjacent thereto, and the plurality of driving gear teeth 431 may include an engagement driving gear tooth 431 disposed between the first driven gear tooth 441 and the second driven gear tooth 442. The first driven gear tooth 441, the second driven gear tooth 442, and the engagement driving gear tooth 431, among the plurality of driving gear teeth and the plurality of driven gear teeth, may be defined as one driving gear tooth and two driven gear teeth engaged with each other according to the relative rotation of the driving gear 430 and the driven gear 440. Since the driving gear tooth disposed between the driven gear teeth changes as the driving gear 430 and the driven gear 440 rotate, the first driven gear tooth 441, the second driven gear tooth 442, and the engagement driving gear tooth 431, which are previously defined, are changed according to the rotation of the driving gear 430 and the driven gear 440.

When the driving gear 430 is rotated in the forward direction, the driven gear 440 may be rotated as the engagement driving gear tooth 431 comes into close contact with the first driven gear tooth 441, and when the driving gear 430 rotates in the reverse direction, the driven gear 440 may be rotated as the engagement driving gear tooth 431 comes into close contact with the second driven gear tooth 442.

Meanwhile, the air purifier 1 may be provided with a discharge space between the body 100 and the wind direction control unit 400, which is a space through which filtered air is discharged. In other words, when the wind direction control member 410 moves to a position spaced apart from the body 100, the discharge space may be provided.

The discharge space may be partitioned into a first discharge area S1 and a second discharge area S2. In this case, the first discharge area S1 may mean an area where air is discharged to one side of the wind direction control unit 400, and the second discharge area S2 may mean an area where air is discharged to the other side of the wind direction control unit 400. For example, when the driving gear 430 is rotated in the forward direction, the wind direction control unit 400 is rotated so that the first discharge area S1 may increase and the second discharge area S2 may decrease. In addition, when the driving gear 430 is rotated in the reverse direction, the wind direction control unit 400 is rotated so that the first discharge area S1 may decrease and the second discharge area S2 may increase. When viewing the air purifier 1 from the side, the first discharge area S1 may be an area located on one side of the elevating unit 500, and the second discharge area S2 may be an area located on the other side of the elevating unit 500. The first discharge area S1 and the second discharge area S2 may form one outlet. In other words, the first discharge area S1 may correspond to one side of one outlet, and the second discharge area S2 may correspond to the other side of the one outlet.

The elevating unit 500 may move the wind direction control unit 400 up and down with respect to the body 100. The elevating unit 500 may move the wind direction control member 410 upward to open the upper portion of the body 100 or descend the wind direction control member 410 to close the upper portion of the body 100. By the elevating unit 500, the wind direction control unit 400 may be placed in an open state in which the upper portion of the body 100 is opened by moving upward with respect to the body 100 as shown in FIG. 3, or may be placed in a closed state in which the upper portion of the body 100 is closed by the wind direction control unit 400 in close contact with the body 100 by moving up toward the body 100 as shown in FIG. 6. In addition, the elevating unit 500 may be supported on the body 100 to be movable in an up-down direction. For example, the elevating unit 500 may include a rack and pinion gear to ascend and descend.

The control device 600 may control the operation of the blower 200, the wind direction control unit 400, and the elevating unit 500 in response to a signal from the manipulation module 700. The control device 600 may be implemented by an arithmetic unit including a microprocessor, a memory, and the like, and since the implementation method is obvious to those skilled in the art, detailed descriptions thereof are omitted.

The manipulation module 700 may include a plurality of input units for a user to control the operation of the air purifier 1, and the input units may include a button, a touch pad, and the like. The manipulation module 700 transmits a signal according to the user's manipulation to the control device 600, and the control device 600 may control other components of the air purifier 1 based on the signal input from the manipulation module 700. The input units provided to the manipulation module 700 may include, for example, a wind speed input unit for controlling the blowing power of the blower, an elevating input unit for moving the elevating unit upward and downward, and a rotation input unit for rotating the wind direction control unit. The manipulation module 700 may be disposed on the wind direction control member 410 to be spaced apart from the rotating shaft R of the wind direction control member 410 when viewed from above. The manipulation module 700 may move down when the driving gear 430 is rotated in the forward direction, and may move up when the driving gear 430 is rotated in the reverse direction.

Hereinafter, the operation and effect of the air purifier 1 according to one embodiment of the present disclosure will be described. The operations described below are performed by controlling the components of the air purifier 1, such as the blower 200, the filter 300, the wind direction control unit 400, and the elevating unit 500, by the control device 600.

When stopping the operation of the rotating driving gear 430, the motor 420 of the air purifier 1 according to one embodiment of the present disclosure may operate so that the rotational direction of the driving gear 430 is temporarily changed and then, transmission of driving force to the driving gear 430 may be stopped. Specifically, the motor may transmit a driving force to rotate the driving gear 430 in one direction, temporarily stop, then drive the driving gear 430 to rotate in the reverse direction by a predetermined angle, and stop the transmission of driving force to the driving gear 430. When the driving gear 430 is rotated and then stopped, it rotates in the reverse direction, so that the engagement driving gear tooth 431 can come into close contact with the second driven gear tooth 442.

Referring to FIG. 7, when the motor 420 operates to rotate the driving gear 430 in the forward direction and then stops, the motor 420 may rotate the driving gear 430 in the reverse direction by a predetermined first angle before completely stopping. Accordingly, the engagement driving gear tooth 431 can come into close contact with the second driven gear tooth 442 by the reverse rotation of the motor immediately before being completely stopped. Therefore, even when the user presses the manipulation module 700 to operate the air purifier 1 in a state in which the wind direction control member 410 is tilted, the wind direction control unit 400 can be prevented from being shaken.

Referring to FIG. 8, the motor 420 may be controlled so that when the driving gear 430 rotates in the reverse direction and stops, the driving gear 430 is rotated in the reverse direction by a second angle different from the first angle to control the motor 420 and any driving gear tooth 431 comes in more close contact with the second driven gear tooth 442. The second angle may be smaller than the first angle, but is not limited thereto.

Meanwhile, when the wind direction control unit 400 is switched from the open state to the closed state, the motor 420 may rotate the wind direction control member 410 such that the wind direction control member 410 is oriented parallel to an upper surface of the body 100 (e.g., horizontally oriented) before the wind direction control member 410 completely closes the discharge areas S1 and S2. In order to bring the wind direction control member 410 into the closed state that closes the upper portion of the body 100, the wind direction control member 410 may be rotated while descending toward the body 100, or may be rotated prior to descending toward the body 100.

In addition, when the wind direction control member 410 descends toward the body 100, in order to prevent a user's finger from being caught between the wind direction control member 410 and the body 100, the wind direction control member 410 may ascend by a predetermined distance after descending toward the body 100, and then descend toward the body 100 again. In other words, when the distance by which the wind direction control member 410 descends to be switched to the closed state is referred to as a first distance, the distance by which the wind direction control member 410 ascends after descending may be referred to as a second distance. The second distance may be smaller than the first distance.

Meanwhile, when the wind direction control unit 400 is switched from the open state to the closed state, the motor 420 may be driven so that the driving gear 430 is rotated in the reverse direction by a second angle or a predetermined angle smaller than the second angle. Accordingly, even when the wind direction control unit 400 is switched to the closed state, a part of the driving gear 430 can be in close contact with the second driven gear tooth 442 when the wind direction control unit 400 is placed in the closed state.

As such, in the case that the driving gear 430 rotates in the reverse direction when the wind direction control unit 400 is switched from the open state to the closed state, the wind direction control member 410 may be inclined so that the second discharge area S2 is larger than the first discharge area S1. In other words, the wind direction control member 410 may descend in the inclined state. The wind direction control member 410 descending in the inclined state may be rotated by being in contact with the body 100 and oriented (e.g., horizontally oriented) to be placed in the closed state. Meanwhile, since the driven gear 440 is rotated in engagement with the wind direction control member 410, the driven gear 440 can be rotated by the wind direction control member 410 being rotated and oriented to be placed in the closed state. In this case, the direction in which the driven gear 440 is rotated is a direction in which the second driven gear tooth 442 and a part of the driving gear tooth 431 more closely contact.

When the wind direction control unit 400 is switched to the closed state, the driving gear tooth 431 previously defined comes into close contact with the second driven gear tooth 442, so the driving gear tooth 431 can be in close contact with the driven gear tooth 442 in advance before the wind direction control unit 400 is in the open state. Accordingly, even when the user presses the manipulation module 700 immediately after the wind direction control unit 400 is switched from the closed state to the open state, the wind direction control unit 400 can be prevented from shaking.

In addition, when the wind direction control member 410 ascends after descending toward the body 100 to prevent the user's finger from being pinched while the wind direction control unit 400 is switched from the open state to the closed state, the motor 420 may be driven so that the driving gear 430 rotates in the reverse direction. In this case, when the wind direction control member 410 initially descends toward the body 100 while the wind direction control member 410 is switched from the open state to the closed state, it descends in a state parallel to the orientation of the wind direction control member 410 in the closed state, and when descending toward the body 100 again after ascending, the wind direction control member 410 may descend in a state in which it is tilted with respect to the orientation of the wind direction control member 410 in the closed state.

Meanwhile, although it has been described above that the wind direction control member 410 is rotated in the reverse direction when it descends for the second time, the embodiment of the present disclosure is not limited thereto, and the driving gear 430 may be rotated in the reverse direction by the operation of the motor 420, regardless of the number of times the wind direction control member 410 descends while the wind direction control member 410 is switched from the open state to the closed state, for example, when the wind direction control member 410 starts descending from the open state to switch from the open state to the closed state. Further, as another example, the driving gear 430 may be rotated in the reverse direction by the operation of the motor 420 before the wind direction control member 410 starts the first descent from the open state to be switched from the open state to the closed state. In this case, the rotation of the driving gear 430 in the reverse direction is a preliminary operation before the wind direction control member 410 descends, and is included in the process of switching the wind direction control unit 400 from the open state to the closed state.

The examples of the present disclosure have been described above as specific embodiments, but these are only examples, and the present disclosure is not limited thereto, and should be construed as having the widest scope according to the technical spirit disclosed in the present specification. A person skilled in the art may combine/substitute the disclosed embodiments to implement a pattern of a shape that is not disclosed, but it also does not depart from the scope of the present disclosure. In addition, those skilled in the art can easily change or modify the disclosed embodiments based on the present specification, and it is clear that such changes or modifications also belong to the scope of the present disclosure.

What is claimed is:

1. An air purifier comprising:

a body having an inlet through which air is introduced;

a blower accommodated in the body and providing a blowing force for causing the air to flow;

a filter filtering the air introduced into the body;

a wind direction control unit that adjusts a direction in which the air passing through the filter is discharged;

a manipulation module that is manipulated by a user and outputs a signal; and a control device for controlling the wind direction control unit in response to the signal, wherein the wind direction control unit includes:

a wind direction control member configured to be rotatable with respect to the body about a rotation axis extending in a horizontal direction;

a motor that provides a driving force for rotating the wind direction control member;

a driving gear rotated by the driving force provided by the motor; and a driven gear rotated by the driving gear, wherein the manipulation module is disposed on the wind direction control member to be spaced apart from the rotation axis when viewed from above, wherein when the driving gear rotates in a forward direction, the wind direction control member rotates in a direction in which the manipulation module moves downward, and when the driving gear rotates in a reverse direction opposite to the forward direction, the wind direction control member rotates in a direction in which the manipulation module moves upward, wherein the control device controls the motor so that when the driving gear is rotated and in the forward direction then stopped, the driving gear is stopped after rotated in the reverse direction by a predetermined angle, wherein the control device controls the motor so that when the driving gear is rotated in the reverse direction and then stopped, the driving gear is stopped after being rotated in the reverse direction by another predetermined angle.

2. The air purifier of claim 1, wherein the driving gear includes a plurality of driving gear teeth, the driven gear includes a plurality of driven gear teeth, the plurality of driven gear teeth include a first driven gear tooth and a second driven gear tooth disposed adjacent to the first driven gear tooth, the plurality of driving gear teeth include an engagement driving gear tooth disposed between the first driven gear tooth and the second driven gear tooth, the driven gear rotates as the engagement driving gear tooth comes in close contact with the first driven gear tooth when the driving gear rotates in the forward direction, and the driven gear rotates as the engagement driving gear tooth comes in close contact with the second driven gear tooth when the driving gear rotates in the reverse direction, and the control device controls the motor so that when the driving gear is rotated in the forward direction and then stopped, the driving gear is rotated in the reverse direction and the engagement driving gear tooth comes in close contact with the second driven gear tooth.

3. The air purifier of claim 2, wherein when the driving gear is rotated in the forward direction and then stopped, the control device controls the motor so that the driving gear is rotated in the reverse direction by a predetermined first angle and the engagement driving gear tooth comes into close contact with the second driven gear tooth.

4. The air purifier of claim 3, wherein when the driving gear is rotated in the reverse direction and then stopped, the control device controls the motor so that the driving gear is rotated in the reverse direction by a second angle different from the first angle and the engagement driving gear tooth comes into close contact with the second driven gear tooth.

5. The air purifier of claim 4, wherein the first angle is greater than the second angle.

6. The air purifier of claim 2, further comprising an elevating unit configured to move the wind direction control unit upward and downward, wherein the wind direction control unit is spaced apart upward from the body by the elevating unit to be placed in an open state in which an upper portion of the body is opened, or comes in close contact with the body by the elevating unit to be placed in a closed state in which the upper portion of the body is closed, and wherein when the wind direction control unit is switched to the closed state, the driving gear is rotated in the reverse direction so that the engagement driving gear tooth comes into close contact with the second driven gear tooth.

7. The air purifier of claim 6, wherein when the wind direction control unit is switched to the closed state, the wind direction control unit is driven so that the wind direction control member descends toward the body by a first distance from the open state, then ascends by a second distance smaller than the first distance, and then descends toward the body again, and wherein the driving gear is rotated in the reverse direction so that the engagement driving gear tooth comes into close contact with the second driven gear tooth after the wind direction control member ascends by the second distance.

8. The air purifier of claim 6, wherein when the wind direction control unit is switched to the closed state, the driving gear is rotated in the reverse direction so that the engagement driving gear tooth comes in close contact with the second driven gear tooth before the wind direction control member starts to descend.

* * * * *